US006669465B2

(12) United States Patent
Yang

(10) Patent No.: US 6,669,465 B2
(45) Date of Patent: Dec. 30, 2003

(54) SAFETY LOCK FOR PIEZOELECTRIC LIGHTER

(76) Inventor: John Jiin Chung Yang, 15443 Proctor Ave., Suite B, Industry, CA (US) 91745

( * ) Notice: Subject to any disclaimer, the term of this patent is extended or adjusted under 35 U.S.C. 154(b) by 0 days.

(21) Appl. No.: 10/016,464

(22) Filed: Dec. 11, 2001

(65) Prior Publication Data

US 2003/0108837 A1 Jun. 12, 2003

(51) Int. Cl.[7] ..... F23D 11/36; F23Q 7/12
(52) U.S. Cl. ..... 431/153; 431/255
(58) Field of Search ..... 431/153, 255

(56) References Cited

U.S. PATENT DOCUMENTS 5,462,432 A 10/1995 Kim
5,829,963 A 11/1998 Ichikawa
5,839,892 A 11/1998 Hwang
6,086,358 A 7/2000 Potskhishvili et al.
6,186,772 B1 2/2001 Huang
6,200,130 B1 * 3/2001 Man ..... 431/153
6,287,109 B1 9/2001 Hirota
6,386,860 B1 * 5/2002 Adams et al. ..... 431/153
2003/0003412 A1 * 1/2003 Yang ..... 431/153

* cited by examiner

*Primary Examiner*—Alfred Basichas
(74) *Attorney, Agent, or Firm*—Raymond Y. Chan; David and Raymond Patent Group

(57) ABSTRACT

A piezoelectric lighter includes a safety lock for preventing the piezoelectric lighter from being accidentally or undesirably ignited, especially by children. The safety lock includes a locking member which includes a pair of guiding arms and is slidably mounted on the ignition button of the piezoelectric lighter for switching between a locked state and an unlocked state of the piezoelectric lighter. In the locked state, the pair of guiding arms are adapted to bias against a top surface of a pair of sliding grooves formed inside a supporting frame of the lighter respectively for restricting a downward movement of said ignition button. Whereas in the unlocked state the pair of guiding arms are adapted to align with said pair of sliding grooves respectively, so that the pair of guiding arms and the ignition button can slide downwardly along the pair of sliding grooves respectively for activating a piezoelectric unit inside the lighter casing to ignite the piezoelectric lighter.

18 Claims, 4 Drawing Sheets

SAFETY LOCK FOR PIEZOELECTRIC LIGHTER

BACKGROUND OF THE PRESENT INVENTION

1. Field of Invention

The present invention relates to a lighter, and more particularly to a piezoelectric lighter which comprises a safety lock for preventing the lighter from being accidentally or undesirably ignited, especially by children.

2. Description of Related Arts

For protecting the safety and benefit of children, the U.S. Consumer Product Safety Commission imposed an important regulation that "Child below 5 years old cannot light the lighter". Some of the piezoelectric lighters, such as U.S. Pat. Nos. 4,786,248, 4,859,172, 5,240,408, 5,368,473, and 5,462,432, each provides a switching mechanism for rendering the piezoelectric lighter child resistant. Each switching mechanism provides a switch member requiring the adult user to turn on before permitting an thumb-operated piezoelectric unit to be depressed to lift a gas pipe to open a gas release valve to emit gas and to generate sparks at the same time to ignite the emitted gas.

However, such conventional piezoelectric lighters with switching mechanism also bear the drawbacks as follows:

1. Some switching mechanisms require the piezoelectric lighter to alter its structure in order to equip with the switch member. Or, numerous of additional elements of the switching mechanism are required to incorporate with the traditional piezoelectric lighter for ensuring the safety feature thereof. Such costly switching mechanism not only increases the cost of the lighter, but also increases the manufacturing procedures of the lighter.

2. If the user forgets to turn off the switch member to its locking position the piezoelectric lighter is already to ignite by any child. In other words such switch-type safety piezoelectric lighter can provide safety function if and only if the adult user remembers to operate an additional turning off action to re-lock the switching mechanism of the piezoelectric lighter again. Most users may even intentionally skip this re-locking operation.

In fact, the conventional switching mechanism of the piezoelectric lighter is a manual lock only but can not be classified as a safety lock because a real safety lighter should normally be locked, that is the piezoelectric lighter should automatically re-lock after each ignition operation, so as to prevent the children from igniting the lighter anytime, or to prevent the lighter from accidentally or unintentionally be ignited by the user.

SUMMARY OF THE PRESENT INVENTION

A main object of the present invention is to provide a safety lock for piezoelectric lighter for preventing accidental or undesirable ignition of the piezoelectric lighter.

Another object of the present invention is to provide a piezoelectric lighter incorporated with a safety lock wherein the lighter can only be ignited by applying simultaneous inward and downward forces to the ignition button in one continuous action. That is, accidental or undesirable ignition would be avoided because of the relatively indirect ignition mechanism.

Another object of the present invention is to provide a safety lock for a piezoelectric lighter which does not alter the original structural design of conventional piezoelectric lighter, thus to minimize the manufacturing cost of the piezoelectric lighter.

Another object of the present invention is to provide a safety lock for a piezoelectric lighter, which can automatically return to a locking condition after each ignition operation, so as to prevent any lighting operation of the piezoelectric unit by locking up the downward movement of the pusher cap.

Accordingly, in order to accomplish the above objects the present invention provides a piezoelectric lighter, which comprises:

- a lighter casing having an internal fuel chamber for storing liquefied fuel;
- a supporting frame which is supported on a ceiling of the lighter casing having a pusher cavity, an ignition cavity, and a pair of supporting walls upwardly extended from two opposite sides of the supporting frame, wherein each of the supporting walls has a longitudinal sliding groove formed thereon;
- an ignition system which comprises a gas-emitting nozzle received in the ignition cavity of the supporting frame and communicated with the internal fuel chamber of the lighter casing, and a piezoelectric unit disposed in said lighter casing for generating sparks;
- an ignition button which is slidably disposed in the pusher cavity of the supporting frame in such a manner that when the ignition button is depressed downwardly, the gas emitting nozzle is lifted up for releasing gaseous fuel, and the piezoelectric unit is arranged to generate sparks for igniting the fuel released from the gas emitting nozzle; and
- a safety lock, comprising a locking member which is slidably mounted on the ignition button and comprises a pair of guiding arms for switching between a locked state and an unlocked state of the lighter, wherein in the locked state, the pair of guiding arms are adapted to bias against top ends of the two sliding grooves respectively for restricting a downward movement of the ignition button, and in the unlocked state, the pair of guiding arms are adapted to move forwardly from the locked position and aligned with the two sliding grooves respectively, so that the pair of guiding arms and therefore the ignition button are capable of sliding downwardly when a depressive force is applied to the ignition button.

In order to ignite the lighter of the present invention one has to apply both the inward and downward forces simultaneously to the safety lock and the ignition button respectively in one action. At the same time the ignition button is being pressed down, the gas-emitting nozzle is lifted up for releasing gaseous fuel. When the ignition button is depressed to a certain ignition point, sparks are generated by the piezoelectric unit to ignite the fuel emitted from the gas-emitting nozzle.

DETAILED DESCRIPTION OF THE PREFERRED EMBODIMENT

Figure 1:
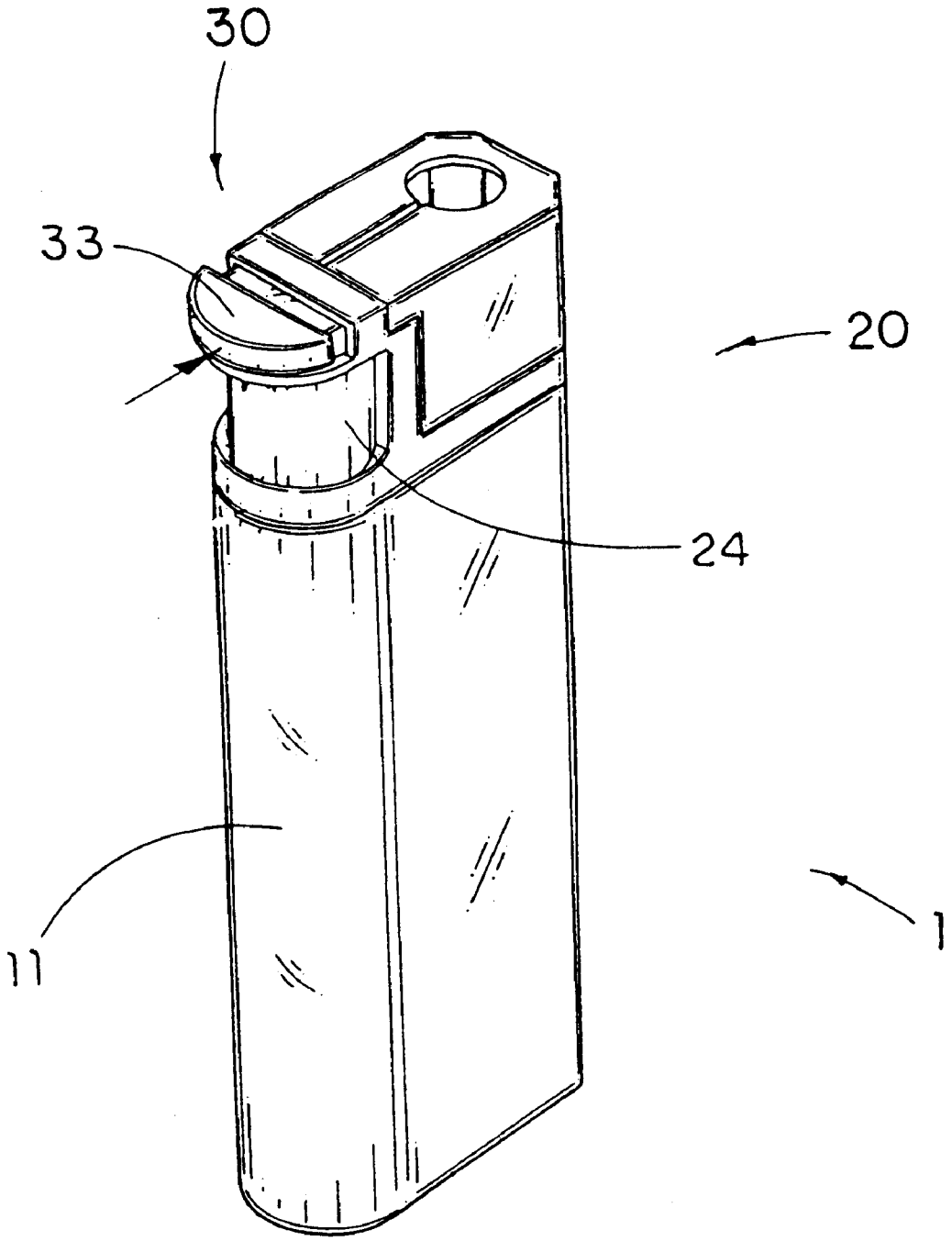
FIG. 1 is an isometric view of a piezoelectric lighter incorporated with a safety lock according to a preferred embodiment of the present invention.

Referring to FIGS. 1 to 4 of the drawings, a piezoelectric lighter incorporated with a safety lock according to a preferred embodiment of the present invention is illustrated. The piezoelectric lighter 1 comprises a lighter casing 11, a supporting frame 10, an ignition system 20 and a safety lock 30 for preventing the piezoelectric lighter 1 from accidentally ignited.

The lighter casing 11 comprises an internal fuel chamber 110 for storing liquefied fuel. The internal fuel chamber 110 has an opening at its top end for communicating with the ignition system 20, so that the fuel inside the internal fuel chamber 110 can be supplied to the ignition system 20 for igniting the lighter.

The supporting frame 10 has an ignition cavity 111 for receiving the ignition system 20 therein and a pusher cavity 112 for supporting an ignition button 24 of the ignition system 20 therein. Essentially, the supporting frame 10 is an upwardly extruded object from a predefined shape that includes a pair of supporting walls 12 which are protruded on opposite sides of a ceiling of the supporting frame 10 respectively.

The ignition system 20 comprises a piezoelectric unit 21 for generating sparks to ignite the piezoelectric lighter 1, a gas emitting nozzle 22 communicating with the internal fuel chamber 110 and controlling the amount of fuel flowing out of the internal fuel chamber 110, a lever 23 pivotally supported by the lighter casing 11 for actuating the gas emitting nozzle 22 to release fuel from the internal fuel chamber 110.

The piezoelectric unit 21 which is fitted in the lighting casing 10 comprises a movable operating part 211 extended through the pusher cavity 112 for generating piezoelectricity, an enlarged pusher head 212 provided at an upper portion of the movable operating part 211 and an ignition tip 213 which is extended from the piezoelectric unit 21 to a position adjacent to the gas emitting nozzle 22 when the gas emitting nozzle 22 is fully lifted up by the lever 23 to release gaseous fuel. In which, a depressible end 231 of the lever 23 is extended underneath the pusher head 212, so that when the movable operating part 211 is depressed downwardly from an original position to a certain ignition point, the depressible end 231 of the lever 23 is depressed downwardly by the pusher head 222 that pivotally lifts up an up-lifting end 232 of the lever to lift up the gas emitting nozzle 22 to release fuel, and, at the same time, sparks are generated at the ignition tip 213 to ignite the fuel emitted through the gas emitting nozzle 22. Note that when the movable operating part 211 is depressed, a resilient clement inside the piezoelectric unit 21 can rebound the movable operating part 211 upwardly to its original position when the depressing force is relieved.

The ignition button 24 is slidably disposed in the pusher cavity 112 of the lighter casing 11 in a vertically movable manner wherein the ignition button 24 is arranged in such manner that when the ignition button 24 is depressed downwardly with respect to the lighter casing 11, the movable operating part 211 of the piezoelectric unit 21 is depressed downwards to generate piezoelectricity.

Figure 2:
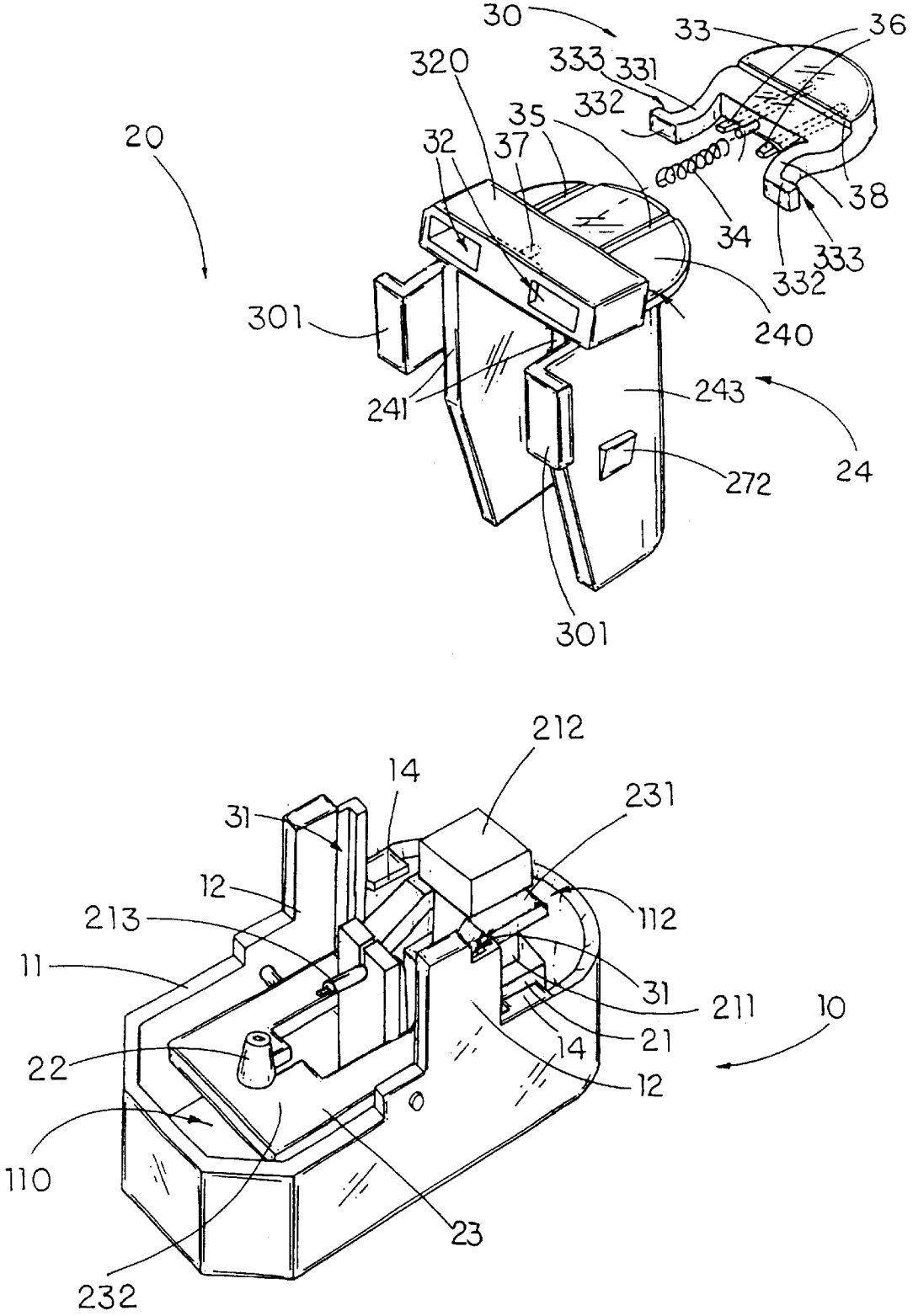
FIG. 2 is an exploded isometric view of the piezoelectric lighter incorporated with a safety lock according to a preferred embodiment of the present invention.

As shown in FIG. 2, the ignition button 24 further comprises a pair of blocking latches 272 protruded outwardly and upwardly from two side walls 243 of the ignition button 24 for biasing against two L-shaped top edges 14 of two side walls of the pusher cavity 112, so as to retain the ignition button 24 in the normal upper position and prevent the ignition button 24 being slid out of the pusher cavity 112, especially by the pushing force of the resilient element inside the piezoelectric unit 21.

According to the present invention, in order to corporate with the safety lock 30, each of the supporting walls 12 has a vertical L-shaped sliding groove 31 formed on the inner side of the supporting wall 12 for slidably coupling the ignition button 24 with the supporting walls 12. Moreover, the ignition button 24, which has a U-shaped cross section defining two front walls 241 and a top panel 240, further comprises a pair of L-shaped guiding members 301 frontwardly protruded from two front walls 241 of the ignition button 24 and has a pair of slider slots 32 transversely formed on a top portion of the top panel 240.

The pair of guiding members 301 is adapted to slide inside the pair of L-shaped sliding grooves 31 of the supporting frame 10 respectively. Such an arrangement allows the ignition button 24 to vertically slide in the pusher cavity 112 of the supporting frame 10.

The safety lock 30 comprises a locking member 33 slidably mounted on the top panel 240 of the ignition button 24. The locking member 33 comprises a pair of L-shaped guiding arms 331 slidably penetrated through the two slider slots 32 and arranged to be driven from a normal locking position to an unlocked position. Each of the guiding arms 331 has a locker lip 332 sidewardly projected therefrom.

Figure 3:
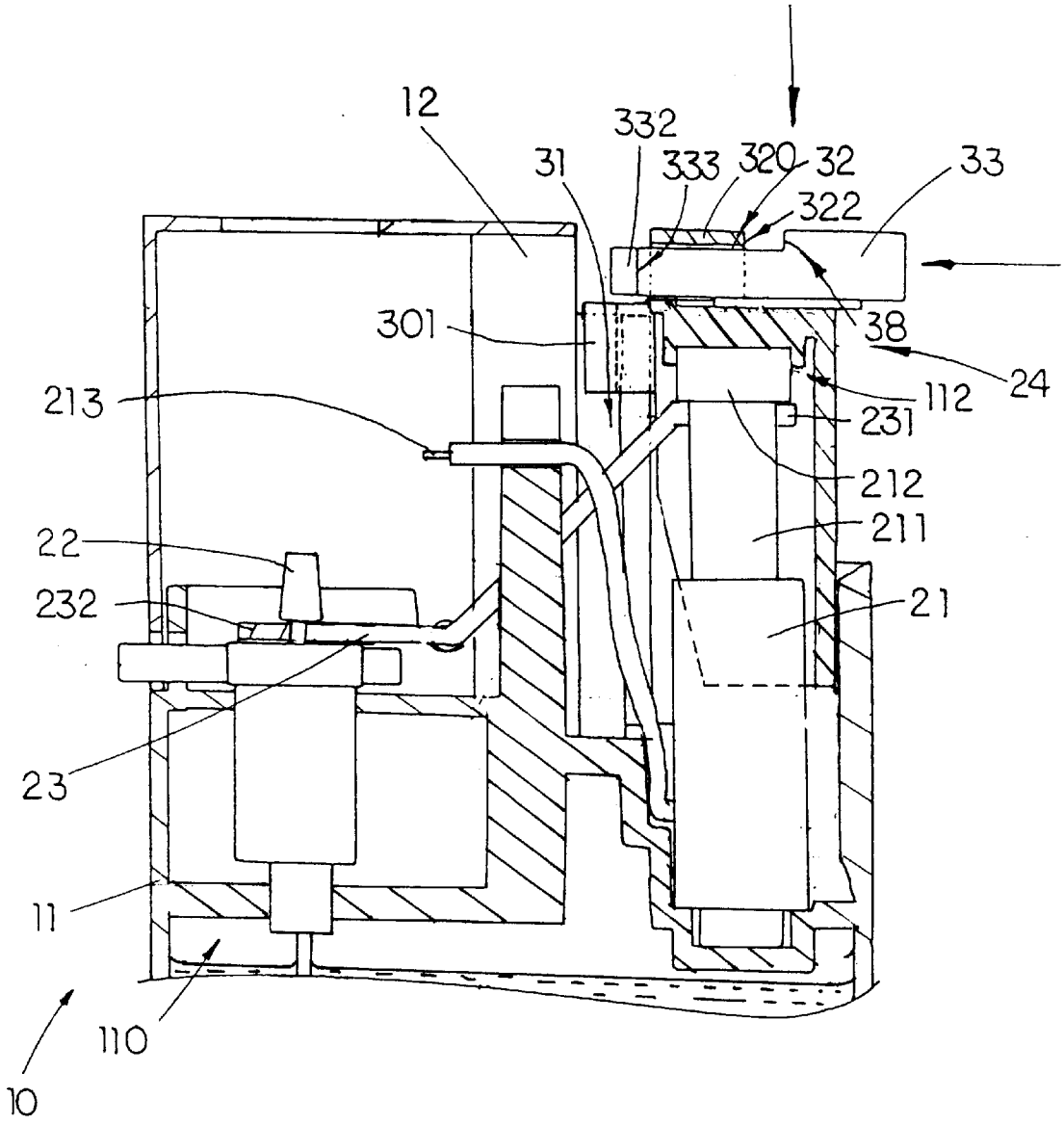
FIG. 3 is a sectional side view of the piezoelectric lighter incorporated with a safety lock according to a preferred embodiment of the present invention, illustrating the lighter is in normal locked state.

The safety lock 30 further comprises a resilient element 34 which is essentially a compressive spring mounted between the locking member 33 and the ignition button 24, for applying an urging pressure against the locking member 33 so as to normally retain the locking member 33 at the normal locked position. In normal locked state as shown in FIG. 3, the locker lips 332 of the two L-shaped guiding arms 331 are biased against two top edges of the two supporting walls 12 respectively for blocking the ignition button from being slid downwardly.

Figure 4:
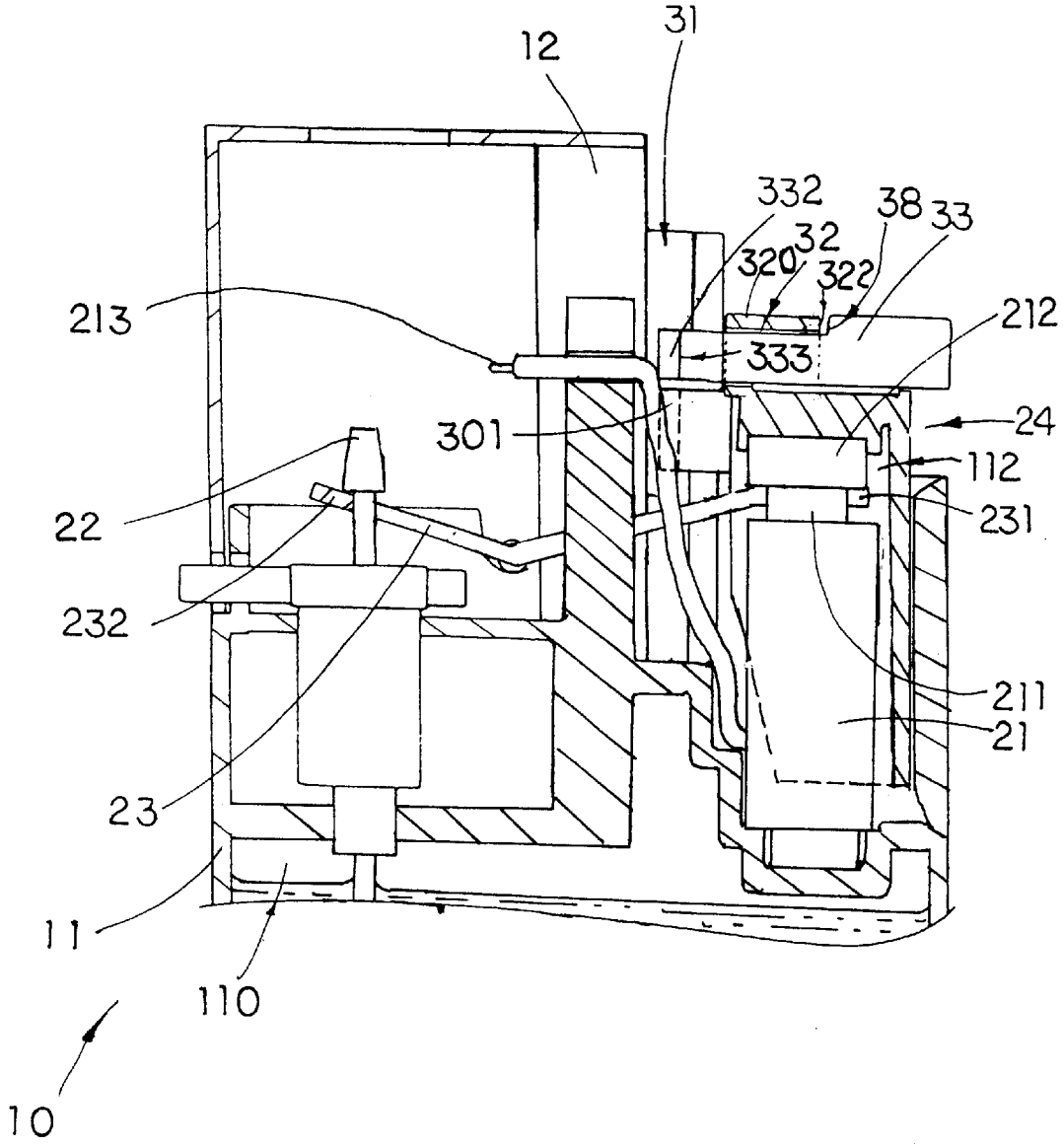
FIG. 4 is a sectional side view of the piezoelectric lighter incorporated with a safety lock according to a preferred embodiment of the present invention, illustrating the lighter is in unlocked state.

In contrast, when the piezoelectric lighter 1 is in the unlocked state as shown in FIG. 4, the locking member 33 is pushed inwardly to compress the resilient element 34 in order for the two locker lips 332 of the two L-shaped guiding arms 331 to be aligned with the two L-shaped sliding grooves 12 respectively. The two guiding arms 331 are then ready to be depressed downwardly to the pusher cavity 112 along the two sliding grooves 31.

According to the preferred embodiment, a locker base 320 is upwardly protruded from a front portion of the top panel 240 of the ignition button 24 and the pair of the slider slots 32 is parallelly provided through the locker base 320. Since the pair of guiding arms is 'L' in shape, a rear surface 333 of the locker lip 332 of each of the guiding arms 33 will bias against a front surface 321 the locker base 320 when the inwardly compressive force is relieved and the resilient element 34 restores to its original shape. Therefore, no further backward movement is allowed and the locking member 33 is retained in position.

As shown in FIG. 2 of the drawings, the safety lock 30 further comprises means for retaining a linear movement of the locking member 33, which comprises at least an elongated guider rib 36 downwardly protruded from a bottom surface of the locking member 33, wherein at least an elongated guiding groove 35 is provided on the top panel 240 of the ignition button 24, wherein the guider rib 36 is arranged to slidably mounted on the guiding groove 35 so as to ensure that the locking member 33 can be slid smoothly on the top panel 240 of the ignition button 24. Furthermore, two spring holders 37 are protruded from the locking member 33 and the locker base 320 respectively for securely supporting the resilient element 34 in position.

In order to ignite the piezoelectric lighter of the present invention, one has to unlock the safety lock 30 by applying an inward force to the locking member 33 to compress the resilient element 34 until the two guiding arms 331 are aligned right above the two sliding grooves 25 respectively. Then, a depressing force has to be simultaneously applied to the top panel 240 of the ignition button 24 for depressing the movable operating part 211 of the piezoelectric unit 21. At the same time the ignition button 24 is being pressed down, the pusher head 212 of the piezoelectric unit 21 depresses the depressible end 231 of the lever 23, and thus lifts up the up-lifting end 232 of the lever 23 to lift up the gas emitting nozzle 22 to release fuel. As a result, the originally liquefied and compressed fuel is being released through the gas emitting nozzle 22. When the movable operating part 211 of the piezoelectric unit 21 is depressed to a certain ignition point, sparks are generated at the ignition tip 213 to ignite the gaseous fuel emitting from the gas emitting nozzle 22.

Note that, for the sake of convenience and simple operations, a stopper edge 38 is formed on a rear portion of the locking member 33, wherein when the locking member 33 is pushed inwards until the stopper edge 38 biases against a rear surface 322 of the locker base 320, the two guiding arms 331 are fittingly aligned with the two L-shaped sliding grooves 31 respectively. In other words, a user only needs to apply an inward force to the locking member 33 until no movement of the locking member is observed, the user is then ready to press down the ignition button 24 to ignite the lighter. Note that all the above-mentioned ignition mechanism can be accomplished in one action.

After ignition, when all the depressing and inward force is relieved, the ignition button 24 is pushed upwardly by the resilient element of the piezoelectric unit 21, and such upward motion should be stopped by the two L-shaped stoppers 272 by biasing against the two blocking latches 14. Meanwhile, the locking member 33 is pushed outwardly by the restoring force of the resilient element 34. The outward motion will then blocked by the front surface of the locker 53. At this point, the piezoelectric lighter of the present invention is restored back to the normal locked state to prevent any downwardly movement of the ignition button 24. It is important to stress that the above piezoelectric lighter can in effect automatically restored to the locked state after an ignition is completed and the depressing force of the user is relieved, therefore preventing the lighter from accidentally or undesirably ignited.

What is claimed is:

1. A piezoelectric lighter, comprising:

a lighter casing having an internal fuel chamber for storing liquefied fuel;

a supporting frame which is supported on a ceiling of said lighter casing having a pusher cavity, an ignition cavity and a pair of supporting walls upwardly extended from two opposite sides of said supporting frame, wherein at least a longitudinal sliding groove is formed on one of said supporting walls;

an ignition system comprising a gas emitting nozzle, which is received in said ignition cavity of said supporting frame and communicated with said internal fuel chamber of said lighter casing, and a piezoelectric unit disposed in said lighter casing for generating sparks towards said gas emitting nozzle;

an ignition button which is slidably disposed in said pusher cavity of said supporting frame in such a manner that, when said ignition button is depressed downwardly, said gas emitting nozzle is lifted up to release said fuel and said piezoelectric unit is arranged to generate sparks for igniting said fuel released through said gas emitting nozzle; and a safety lock, comprising a locking member which is slidably mounted on said ignition button and comprises at least a guiding arm for switching between a locked state and an unlocked state of said piezoelectric lighter, wherein in said locked state, said guiding arm is adapted to bias against a top end of said respective supporting wall for restricting a downward movement of said ignition button, wherein in said unlocked state, said guiding arm is moved forwardly from said locked state and aligned with said sliding groove to enable said guiding arm and said ignition button sliding downwardly when a depressive force is applied to said ignition button.

2. A piezoelectric lighter, as recited in claim 1, wherein another longitudinal sliding groove is formed on said another supporting wall in such a manner that said two sliding grooves are formed on inner sides of said two supporting walls respectively, wherein said ignition button further comprises a pair of guiding members frontwardly protruded from two front walls of said ignition button for sliding inside said two sliding grooves of said supporting walls respectively so as to allow said ignition button to longitudinally slide in said pusher cavity of said supporting frame.

3. A piezoelectric lighter, as recited in claim 2, wherein said ignition button comprises a top panel having a pair of slider slots transversely formed thereon and said locking member further comprises another guiding arm, wherein said two guiding arms are slidably penetrated through said two slider slots and arranged to be driven from a normal locking position to an unlocked position.

4. A piezoelectric lighter, as recited in claim 3, wherein said safety lock further comprises a resilient element mounted between said locking member and said ignition button for applying an urging pressure against said locking member so as to normally retain said locking member in said locked state, wherein in said locked state, said two guiding arms are biased against two top edges of said two supporting walls respectively for blocking said ignition button from being slid downwardly, wherein in said unlocked state, said locking member is pushed inwardly to compress said resilient element to align said two guiding arms with said two sliding grooves respectively, and thus said two guiding arms are able to be depressed downwardly to said pusher cavity along said two sliding grooves.

5. A piezoelectric lighter, as recited in claim 4, wherein each of said guiding arms has a locker lip sidewardly projected therefrom, wherein in said locked state, said locker lips of said two guiding arms are biased against said two top edges of said two supporting walls respectively, and in said unlocked state, said two locker lips of said two guiding arms are aligned with said two sliding grooves respectively.

6. A piezoelectric lighter, as recited in claim 4, wherein a locker base is upwardly protruded from a front portion of said top panel of said ignition button and said two slider slots are parallelly provided through said locker base, wherein a rear surface of said locker lip of each of said guiding arms is arranged to bias against a front surface of said locker base in said locked state.

7. A piezoelectric lighter, as recited in claim 5, wherein a locker base is upwardly protruded from a front portion of said top panel of said ignition button and said two slider slots are parallelly provided through said locker base, wherein a real Surface of said locker lip of each of said guiding arms is arranged to bias against a front surface of said locker base in said locked state.

8. A piezoelectric lighter, as recited in claim 3, wherein said locking member further comprises at least an elongated guider rib downwardly protruded from a bottom surface of said locking member, wherein at least an elongated guiding groove is provided on said top panel of said ignition button, wherein said guider rib is arranged to slidably mounted on said guiding groove so as to ensure that said locking member to be slid smoothly on said top panel of said ignition button.

9. A piezoelectric lighter, as recited in claim 4, wherein said locking member further comprises at least an elongated guider rib downwardly protruded from a bottom surface of said locking member, wherein at least an elongated guiding groove is provided on said top panel of said ignition button, wherein said guider rib is arranged to slidably mounted on said guiding groove so as to ensure that said locking member to be slid smoothly on said top panel of said ignition button.

10. A piezoelectric lighter, as recited in claim 6, wherein said locking member further comprises at least an elongated guider rib downwardly protruded from a bottom surface of said locking member, wherein at least an elongated guiding groove is provided on said top panel of said ignition button, wherein said guider rib is arranged to slidably mounted on said guiding groove so as to ensure that said locking member to be slid smoothly on said top panel of said ignition button.

11. A piezoelectric lighter, as recited in claim 4, wherein two spring holders are protruded from said locking member and said locker base respectively for securely supporting said resilient element in position.

12. A piezoelectric lighter, as recited in claim 6, wherein two spring holders are protruded from said locking member and said locker base respectively for securely supporting said resilient element in position.

13. A piezoelectric lighter, as recited in claim 9, wherein two spring holders are protruded from said locking member and said locker base respectively for securely supporting said resilient element in position.

14. A piezoelectric lighter, as recited in claim 10, wherein two spring holders are protruded from said locking member and said locker base respectively for securely supporting said resilient element in position.

15. A piezoelectric lighter, as recited in claim 6, wherein a stopper edge is formed on a rear portion of said locking member in such a manner that when said locking member is pushed inwards until said stopper edge biases against a rear surface of said locker base, said two guiding arms are fittingly aligned with said two L-shaped sliding grooves respectively.

16. A piezoelectric lighter, as recited in claim 10, wherein a stopper edge is formed on a rear portion of said locking member in such a manner that when said locking member is pushed inwards until said stopper edge biases against a rear surface of said locker base, said two guiding arms are fittingly aligned with said two L-shaped sliding grooves respectively.

17. A piezoelectric lighter, as recited in claim 12, wherein a stopper edge is formed on a rear portion of said locking member in such a manner that when said locking member is pushed inwards until said stopper edge biases against a rear surface of said locker base, said two guiding arms are fittingly aligned with said two L-shaped sliding grooves respectively.

18. A piezoelectric lighter, as recited in claim 14, wherein a stopper edge is formed on a rear portion of said locking member in such a manner that when said locking member is pushed inwards until said stopper edge biases against a rear surface of said locker base, said two guiding arms are fittingly aligned with said two L-shaped sliding grooves respectively.

* * * * *